US009033414B2

(12) United States Patent
Olarte

(10) Patent No.: US 9,033,414 B2
(45) Date of Patent: May 19, 2015

(54) STACKABLE CHAIR WITH TELESCOPIC LEG MECHANISM

(75) Inventor: Alvaro Mauricio Olarte, Aventura, FL (US)

(73) Assignee: SERIES INTERNATIONAL LLC, Aventura, FL (US)

( * ) Notice: Subject to any disclaimer, the term of this patent is extended or adjusted under 35 U.S.C. 154(b) by 69 days.

(21) Appl. No.: 13/277,508

(22) Filed: Oct. 20, 2011

(65) Prior Publication Data

US 2012/0126596 A1 May 24, 2012

Related U.S. Application Data

(60) Provisional application No. 61/405,392, filed on Oct. 21, 2010.

(51) Int. Cl.
*A47C 3/04* (2006.01)

(52) U.S. Cl.
CPC ..... *A47C 3/04* (2013.01)

(58) Field of Classification Search
CPC ..... A47C 3/04
USPC ..... 297/239, 452.4, 440.23, 440.24, 297/440.14, 440.15, 440.22, 440.1, 447.2, 297/446.2, 448.1
See application file for complete search history.

(56) References Cited

U.S. PATENT DOCUMENTS

| | | | | |
|---|---|---|---|---|
| 2,688,997 | A | 9/1954 | Miller | |
| 3,695,693 | A * | 10/1972 | Acton et al. | 297/239 |
| 3,759,572 | A | 9/1973 | Koepke | |
| 4,097,089 | A | 6/1978 | Petersen | |
| 4,240,663 | A | 12/1980 | Locher | |
| 4,766,838 | A * | 8/1988 | Johnson | 114/363 |
| 4,984,768 | A * | 1/1991 | Kolber et al. | 297/16.1 |
| 5,123,702 | A * | 6/1992 | Caruso | 297/440.21 |
| 5,681,089 | A * | 10/1997 | Lin | 297/440.1 |
| 5,944,387 | A | 8/1999 | Stumpf | |
| 6,352,307 | B1 * | 3/2002 | Engman | 297/284.11 |
| 6,450,579 | B1 | 9/2002 | Nylander et al. | |
| 6,474,744 | B1 * | 11/2002 | Taylor et al. | 297/440.22 |
| 7,134,728 | B1 * | 11/2006 | Buhrman | 297/440.14 |
| 8,104,838 | B2 * | 1/2012 | Tsai | 297/411.37 |
| 2004/0041455 | A1 * | 3/2004 | Tenbroeck et al. | 297/440.24 |
| 2008/0084104 | A1 * | 4/2008 | VanHorn | 297/452.4 |
| 2008/0105173 | A1 | 5/2008 | Weber | |
| 2009/0121534 | A1 * | 5/2009 | Brauning | 297/440.14 |
| 2011/0198902 | A1 * | 8/2011 | Renbarger et al. | 297/219.1 |

OTHER PUBLICATIONS

International Search Report and Written Opinion of the International Searching Authority; Application No. PCT/US2011/057209; Issued: Feb. 29, 2012; Mailing Date: Mar. 8, 2012; 9 pages.

* cited by examiner

*Primary Examiner* — David R Dunn
*Assistant Examiner* — Tania Abraham
(74) *Attorney, Agent, or Firm* — St. Onge Steward Johnston & Reens LLC

(57) ABSTRACT

A chair for facilitating efficient stacking includes a seat element having a seat frame, a plurality of front legs attached to a front portion of the seat element, a plurality of rear legs attached to a back portion of the seat element, and one or more telescopic leg mechanisms disposed on at least one of the front or rear legs, wherein the telescopic leg mechanisms provide for lateral movement of the at least one of the front or rear legs with respect to the seat element.

29 Claims, 11 Drawing Sheets

STACKABLE CHAIR WITH TELESCOPIC LEG MECHANISM

CROSS-REFERENCE TO RELATED APPLICATIONS

This patent application claims the benefit of, under Title 35, United States Code, Section 119(e), U.S. Provisional Patent Application No. 61/405,392, filed Oct. 21, 2010, which is incorporated herein by reference.

FIELD OF THE INVENTION

The invention relates to a chair and more specifically, to a chair capable of being placed in a space-saving, vertical stack during storage or transportation.

BACKGROUND OF THE INVENTION

Furniture which can collapse temporarily and/or placed in a stack help facilitate the manner in which such furniture is placed in storage or transported from one location to another. This advantage is particularly important to furniture manufacturers who strive to maximize the amount of furniture that can be positioned in a given cargo space during shipment to retail stores. A typical example of furniture which can be collapsed or placed in a stack during storage or transportation is the stackable chair. With the ability to be stacked into a vertical fashion, stackable chairs require less storage space than non-stackable chairs, and thus increase the number of chairs that can be shipped in a given vehicle at any one time.

Some chairs allow for some form of lateral adjustment of the seat or legs in order to change the size of the chair. With such a feature, the chair can become more portable during shipping. For example, U.S. Pat. No. 3,759,572 to Koepke discloses a sling seat frame comprising a plurality of elongated tubular connection elements and two frame segments forming the seat. During assembly, the tubular connection elements are placed in sliding engagement with the first frame segment. The second frame segment is connected to the tubular connection elements by means of threaded tips on the second frame segment and corresponding threaded nuts mounted within the connection elements. To shorten or widen the width of the sling seat, a user must rotate the elongated tubular connection elements in order to dispose the threaded tips further within or without the threaded nuts. However, the user must individually rotate all the connection elements and guess whether the connection elements are placed in matching configurations to provide equal dimensions throughout the sling seat. Prior to assembly, the Koepke seat, in a fully detached state, can be shipped in a space saving mode. However, with separate components, there is the potential of misplacing parts that could render the sling seat unusable.

Other efforts have been made to provide a chair with lateral adjustment means to adapt it into a portable arrangement. For example, U.S. Patent Publication No. 2008/0084104 to VanHorn discloses a portable, laterally-extendable bench seat. The seat bottom and seat back each comprise telescopically interconnected components for converting the seat into a bench. However, VanHorn does not provide for comfortable seating due to the uneven surfaces of the seat bottom and seat back. Furthermore, the chair disclosed in VanHorn cannot be placed in a stack with other chairs of the same design.

U.S. Patent Publication No. 2008/0105173 to Weber describes a pupil desk having two lateral C leg frames that can be disposed either beneath the edges of the desk top or outside the edges of the desk top. In order to switch the pupil desk between the two configurations, a person must laterally pull out or push in the legs in a transverse direction. When the desk is configured with its leg frames disposed outside the desk top, the desk can be placed into a vertical stack. However, Weber requires spacers disposed on the leg frames in order to maintain a vertical alignment and prevent the stack of pupil desks from leaning forward in an unsafe manner.

It is therefore desired to provide a stackable chair with a telescopic leg mechanism which, when placed in a stack, requires minimal space, particularly in the vertical direction, during storage or transportation. It is also desired to provide a stackable chair with telescopic leg mechanism that is easily and safely loaded onto an existing stack of chairs using a forward motion.

SUMMARY OF THE INVENTION

Accordingly, it is an object of the present invention to provide a stackable chair that accommodates a user with a wide, even-surface seat for increased comfort and seating capacity without preventing the chair from being placed in a vertical stack.

It is another object of the present invention to provide a stackable chair that can be placed in a row with other stackable chairs such that the edges of adjacent seats are flush with one another. With no open space between each individual seat, a continuous seating surface is formed.

It is an additional object to provide a stackable chair that can be easily and safely placed onto a lower stackable chair from the front without having to lift the stackable chair through its entire height over the lower stackable chair. This object becomes more apparent as the number of stackable chairs in a stack increases.

It is a further object of the present invention to provide a stackable chair which utilizes space efficiently by leaving no open space disposed between the seating elements of stackable chairs adjacently stacked. With the surface of the seating element flush with another, the stackable chair saves vertical space when placed in a stack.

These and other objectives are achieved by providing a stackable chair having a backrest element, a seat element, front legs, rear legs and a telescopic leg mechanism, wherein at least one of the rear legs or front legs extend into a configuration wider than the seat element, or retract into an inline configuration with the seat element by means of the telescopic leg mechanism.

These and other objectives are also achieved by providing a chair for facilitating efficient stacking includes a seat element having a seat frame, a plurality of front legs attached to a front portion of the seat element, a plurality of rear legs attached to a back portion of the seat element, and one or more telescopic leg mechanisms disposed on at least one of the front or rear legs. The telescopic leg mechanisms provide for lateral movement of the at least one of the front or rear legs with respect to the seat element.

Further objectives are achieved by providing a chair for facilitating efficient stacking, including a seat element having a seat frame, a plurality of front legs attached to a front portion of the seat element, a plurality of rear legs attached to a back portion of the seat element, a plurality of first telescopic leg mechanisms disposed on at least one of the front legs, and a plurality of second telescopic leg mechanisms disposed on at least one of the rear legs. The first and second telescopic leg mechanisms provide for lateral movement of the at least one of the front legs and the at least one of the rear legs with respect to the seat element.

Other objectives of the invention are achieved by providing a stack of chairs including two or more chairs, each of the chairs having a seat frame, one or more front legs attached to a front portion of the seat frame, one or more rear legs attached to a back portion of the seat frame, and one or more telescopic leg mechanisms disposed on at least one of the front or rear legs. Each of the telescopic leg mechanisms provide for lateral movement, between a retracted position and an extended position, of the at least one of the front or rear legs with respect to the seat frame. The telescope leg mechanisms of a first one of said chairs in the stack are disposed in the extended position such that the front and/or rear legs of the first one of the chairs extend about the seat frame of a second one of the chairs positioned below the first one of the chairs. In some embodiments, seat elements or bottoms of the chairs are in contact and/or substantially adjacent to one another.

Further provided is a row of adjacent chairs, wherein each chair includes one or more telescopic leg mechanisms disposed in a retracted position, such that the adjacent chairs can be placed side-by-side resulting in a flush and/or continuous row of seat elements or seat bottoms of adjacent chairs. Also provided is a method of vertically stacking chairs, including the steps of at least partially extending one or more telescoping mechanisms on each of the chairs, adding each of the chairs into the vertical stack using a substantially forward motion, and stacking the chairs such that seat elements or bottoms of the chairs are in contact and/or substantially adjacent to one another.

The stackable chairs with telescopic leg mechanisms according to the present invention improves the storage and transportation of chairs and avoids the disadvantages/inconveniences associated with prior art chairs. It increases the number of chairs that can be stowed in a given amount of space while requiring a simple and safe maneuver for loading stackable chairs into a stack. Furthermore, with each stackable chair added to the stack, the present invention avoids the tendency for the center of gravity of the stack to shift forward.

Other objects of the invention and its particular features and advantages will become more apparent from consideration of the following drawings and accompanying detailed description.

DETAILED DESCRIPTION OF THE INVENTION

Figure 1:
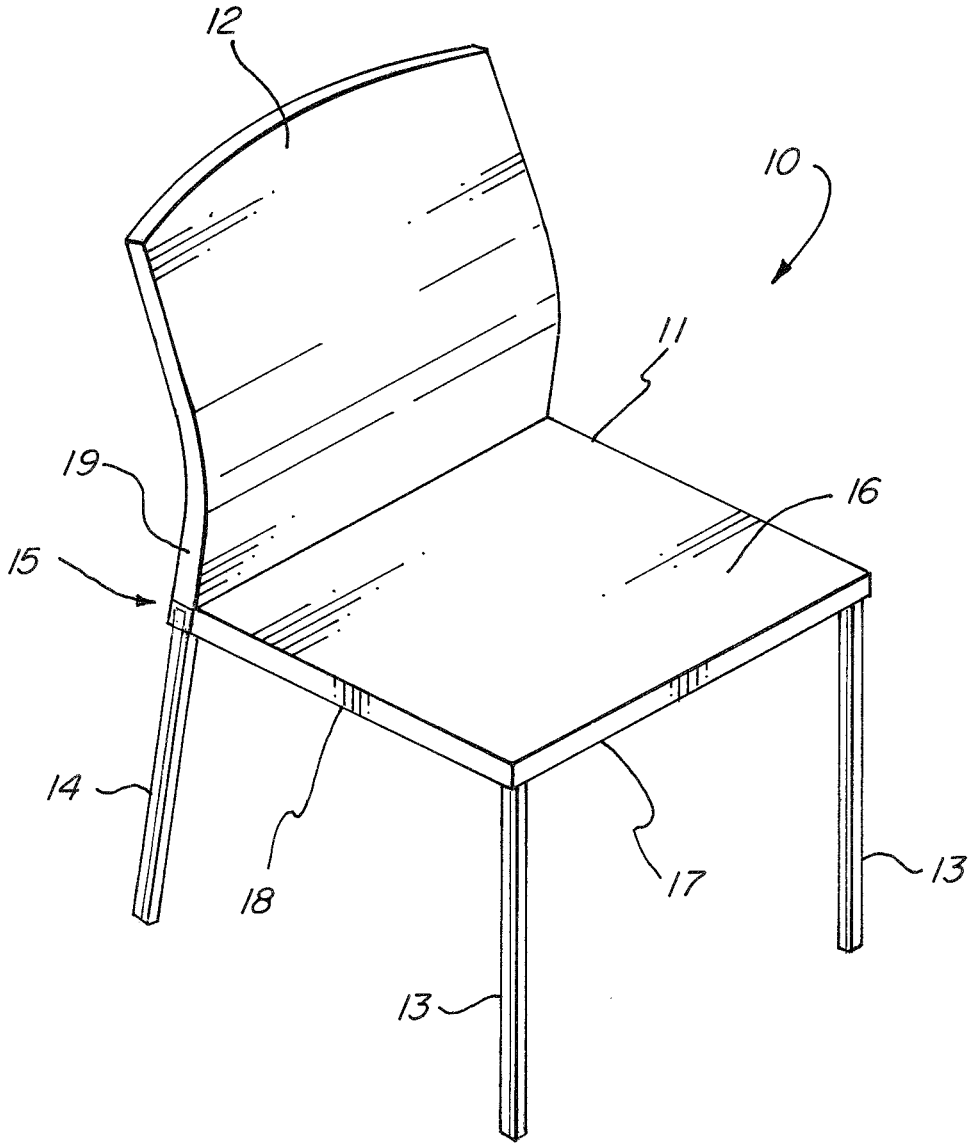
FIG. 1 is a perspective view of a stackable chair with telescopic leg mechanism according to an exemplary embodiment of the present invention in a retracted position.
Figure 2:
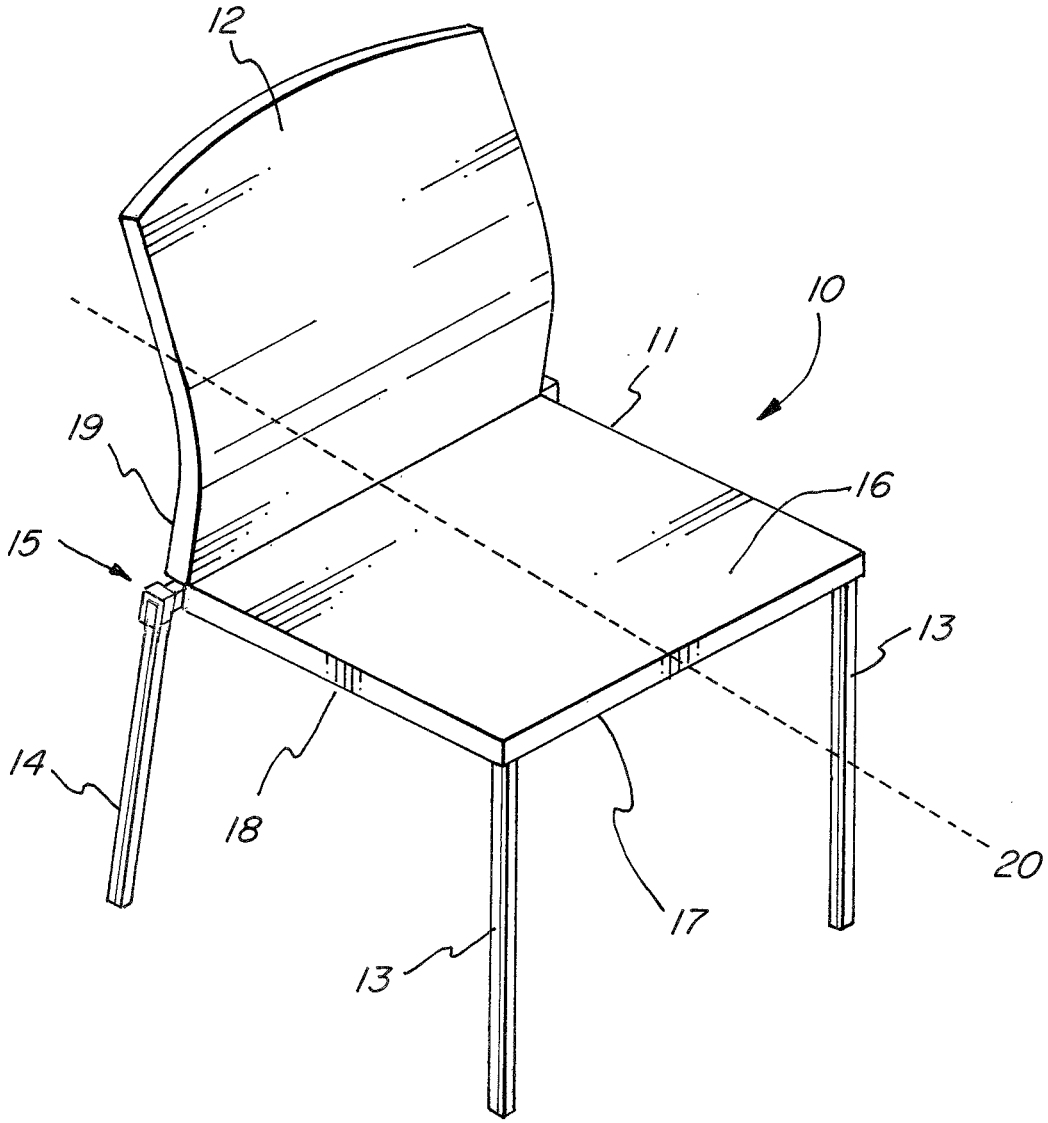
FIG. 2 is a perspective view of the stackable chair with telescopic leg mechanism shown in FIG. 1 in an extended position.
Figure 3:
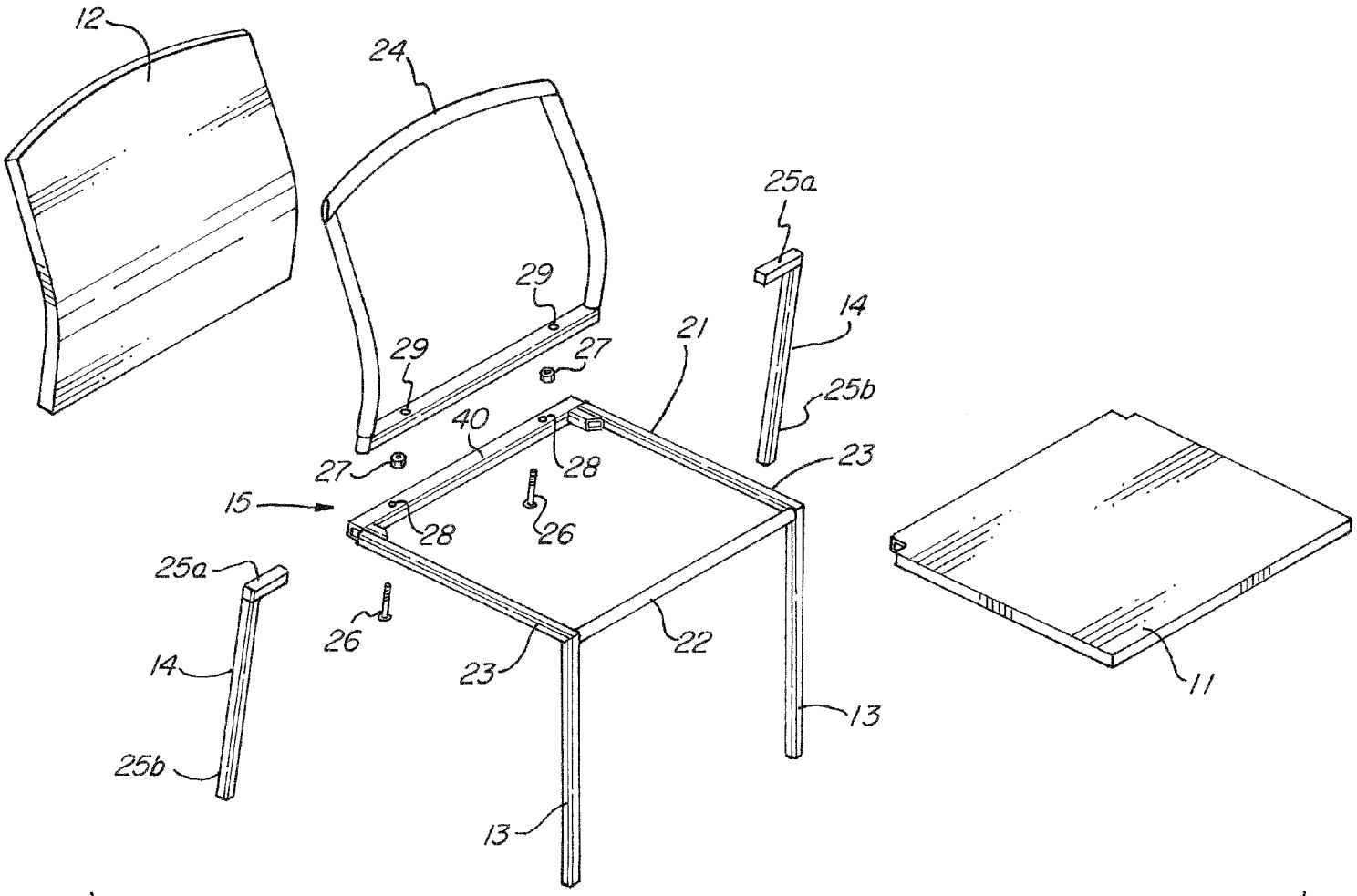
FIG. 3 is an exploded view of the stackable chair with telescopic leg mechanism shown in FIG. 1.

Referring to the figures in detail and first to FIGS. 1-3, there is shown an exemplary embodiment of a stackable chair with telescopic leg mechanism. FIG. 1 shows the stackable chair 10 with telescopic leg mechanism 15 in a fully retracted position. The stackable chair 10 includes a seat element 11 (e.g., including a foam pad) having a upper surface 16 and a lower surface 17, a backrest element 12, a pair of front legs 13 attached to the front portion of seat element 11, a pair of rear legs 14 attached to the telescopic leg mechanism 15, wherein the telescopic leg mechanism 15 attaches to the back portion of seat element 11 and a lower edge of said backrest element 12. With the telescopic leg mechanism 15 in a fully retracted position, the rear legs 14 are positioned inline with the front legs 13, seat edge 18 of seat element 11 and side edge 19 of backrest element 12.

Figure 8:
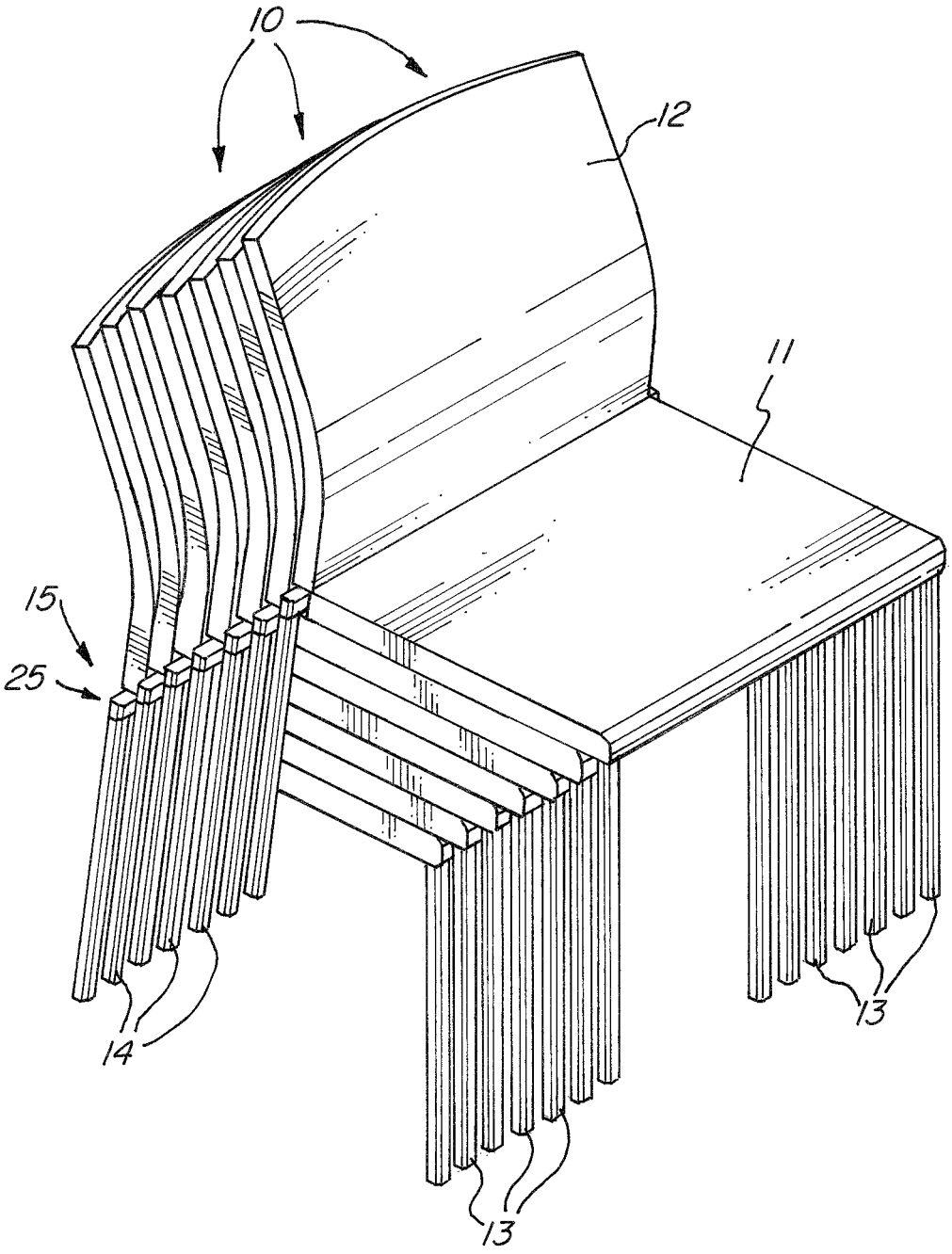
FIG. 8 is a perspective view of a plurality of stackable chairs with telescopic leg mechanisms of FIG. 2 in a vertical stack.

FIG. 2 shows the stackable chair 10 with telescopic leg mechanism 15 and rear legs 14 in an extended position. The telescopic leg mechanism 15 and rear legs 14 can be configured into the extended position by pulling the rear legs 14 in a lateral motion away from center line 20 of seat element 11. The telescopic leg mechanism 15 and rear legs 14 can be extended away from center line 20 to avoid interference between the rear legs 14 and any portion of seat element 11 of any adjacently stacked stackable chair 10, as shown in FIG. 8. In addition, telescopic leg mechanism 15 allows for the rear legs 14 to be held in a retracted position and to prevent the rear legs 14 from being pulled beyond a maximum length away from center line 20. When the telescopic leg mechanism 15 is in an extended position, rear legs 14 assume a wider stance than front legs 13 and protrude beyond seat edge 18 and side edge 19.

In order to return the rear legs 14 and the telescopic leg mechanism 15 into a fully retracted position, the rear legs 14 must be pushed in an inward direction towards center line 20 until the rear legs 14 are inline with the front legs 13, seat edge 18 and side edge 19.

FIG. 3 shows the stackable chair in an exploded view. The seat element 11 comprises a foam pad (e.g., 11), a seat frame 21 having a front lateral frame member 22, two side frame members 23 and a rear lateral frame member 40. The seat frame 21 is formed within the seat element 11, which can be made of any material suitable for supporting the weight of a person. The backrest element 12 is also made of any material suitable for supporting the weight of a person. In further detail, the backrest element 12 comprises a backrest frame 24, which in turn attaches to the seat frame 21 at the rear lateral frame member 40. Any attachment means can be used to securely join the backrest frame 24 to the seat frame 21. In a preferred embodiment, the combination of screws 26, washers 27, and nuts 29 provide the means for attaching the backrest frame 24 to the seat frame 21. Specifically, screws 26 are feed from the bottom of the rear lateral frame member 40 through holes 28 disposed on the top and bottom surfaces of the rear lateral frame member 40, through washers 27, and into holes 32 (visible in FIG. 4) disposed on the bottom of the backrest frame 24. The nuts 29 mounted to the backrest frame 24 then receive the screws 26 to form a secure attachment between the backrest frame 24 and seat frame 21.

Figure 4:
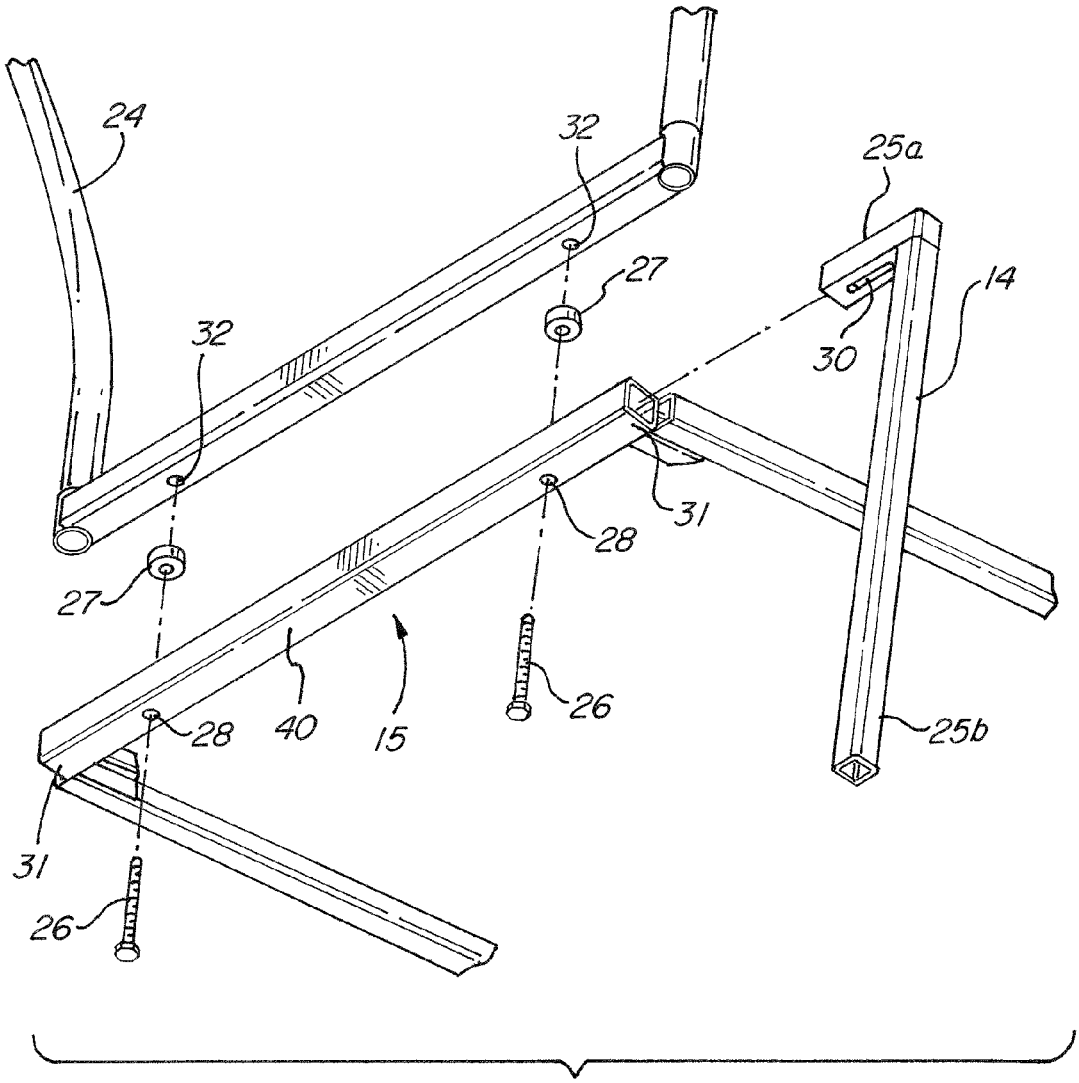
FIG. 4 is a detailed, exploded view of the telescopic leg mechanism seen from the back and underneath the stackable chair shown in FIG. 1.
Figure 5:
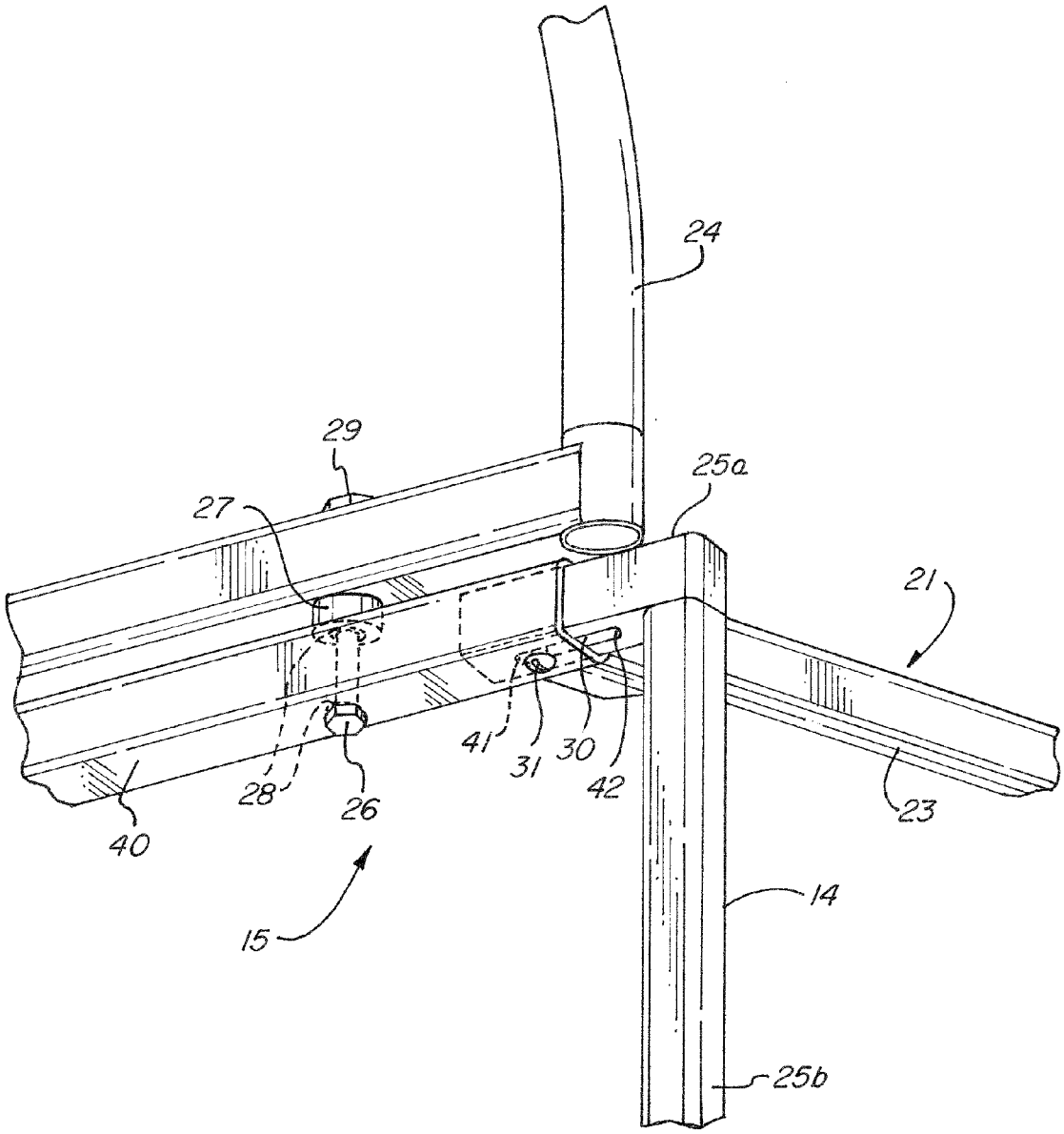
FIG. 5 is a detailed view of the telescopic leg mechanism seen from the back and underneath the stackable chair shown in FIG. 2.

FIGS. 4 and 5 illustrate how one exemplary embodiment of the telescopic leg mechanism 15 functions. The telescopic leg mechanism 15 comprises the rear lateral frame member 40, rear legs 14, guide channels 30, and guide pins 31. Each of the rear legs 14 further comprises a telescoping member 25*a* and a vertical member 25*b*. On a side portion of the telescoping member 25*a* is a guide channel 30 having a function explained below. The rear lateral frame member 40 is adapted at both ends to receive the telescoping members 25*a* of rear legs 14. When the telescoping members 25*a* are inserted within the rear lateral frame member 40, a snug fit is formed. Near both ends of the rear lateral frame member 40 are guide pins 31 disposed on a side portion of the rear lateral frame member 40. In some embodiments of the chair, the guide pins 31 are disposed on a bottom side of the lateral frame member 40. In other embodiments, the guide pins 31 are disposed on a front side or rear side of the lateral frame member 40.

When the telescoping members 25*a* are received within the rear lateral frame member 40, the guide pins 31 assume a position within the guide channels 30. In some embodiments, the guide pins 31 are retractable (e.g., spring loaded) for ease of assembly. In some embodiments, the guide pins 31 are pressure pins. Further, in other embodiments, the guide pins are screws. The arrangement of guide pins 31 within guide channels 30 limits how far the rear legs 14 can extend away or retract toward the side frame members 23 of seat frame 21. Thus, when rear legs 14 are pulled outwards away from seat frame 21 and seat element 16, the telescoping members 25*a* slide out from within the rear lateral frame member 40 until the guide pins 31 abut against the inner ends 41 of guide channels 30. Conversely, when rear legs 14 are pushed inwards towards seat frame 21, the telescoping members 25*a* slide further within the rear lateral frame member 40 until the guide pins 31 abut against the outer ends 42 of guide channels 30. The point at which guide pins 31 abut against the outer ends 42 corresponds to the rear legs 14 becoming flush with seat element 16.

FIGS. 4 and 5 illustrate just one exemplary embodiment of the telescopic leg mechanism 15 and are not intended to exclude other configurations and arrangements. For example, in another exemplary embodiment, the guide channels 30 are located on the rear lateral frame member 40 and the guide pins 31 are disposed on the telescoping members 25*a*.

In some embodiments, a locking mechanism disposed at the telescopic leg mechanism 15 may be provided. The locking mechanism secures and maintains the rear legs at specified positions—such as fully retracted or fully extended—in order to prohibit involuntary lateral movement of the rear legs 14 and to ensure balanced distribution of weight between the rear legs 14 and front legs 13.

Figure 6:
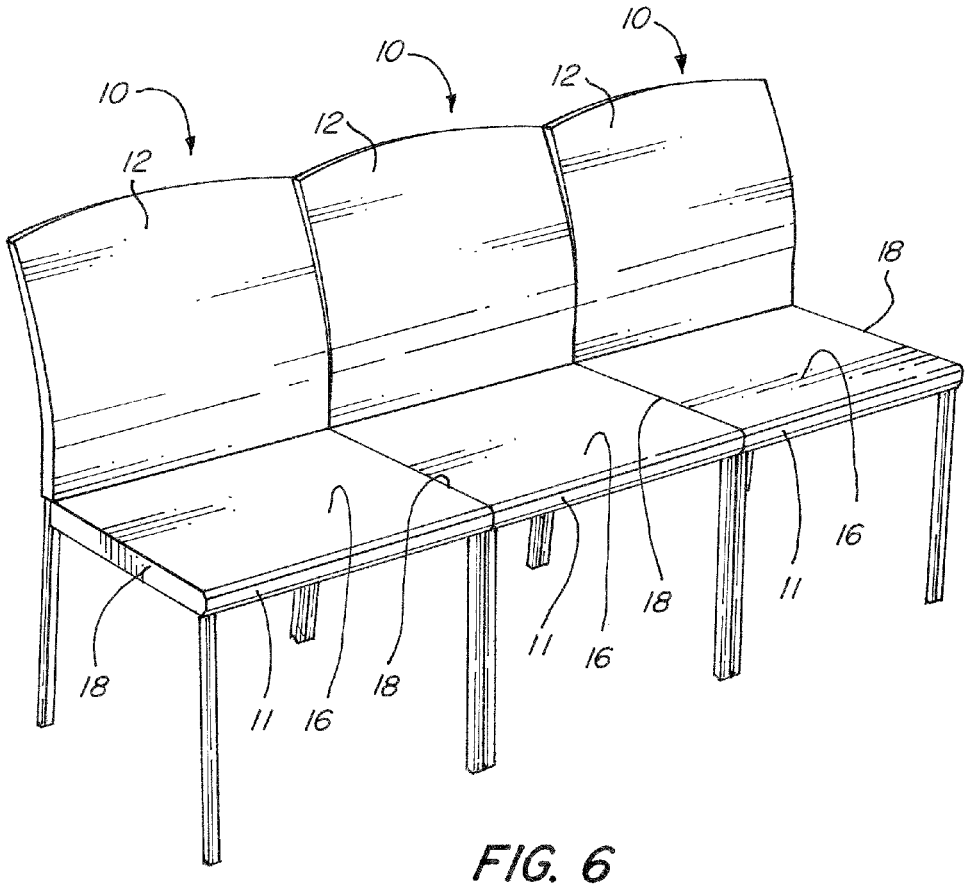
FIG. 6 is a perspective view of three stackable chairs with telescopic leg mechanisms of FIG. 1 positioned side-by-side with their seat elements flush against the other.
Figure 7:
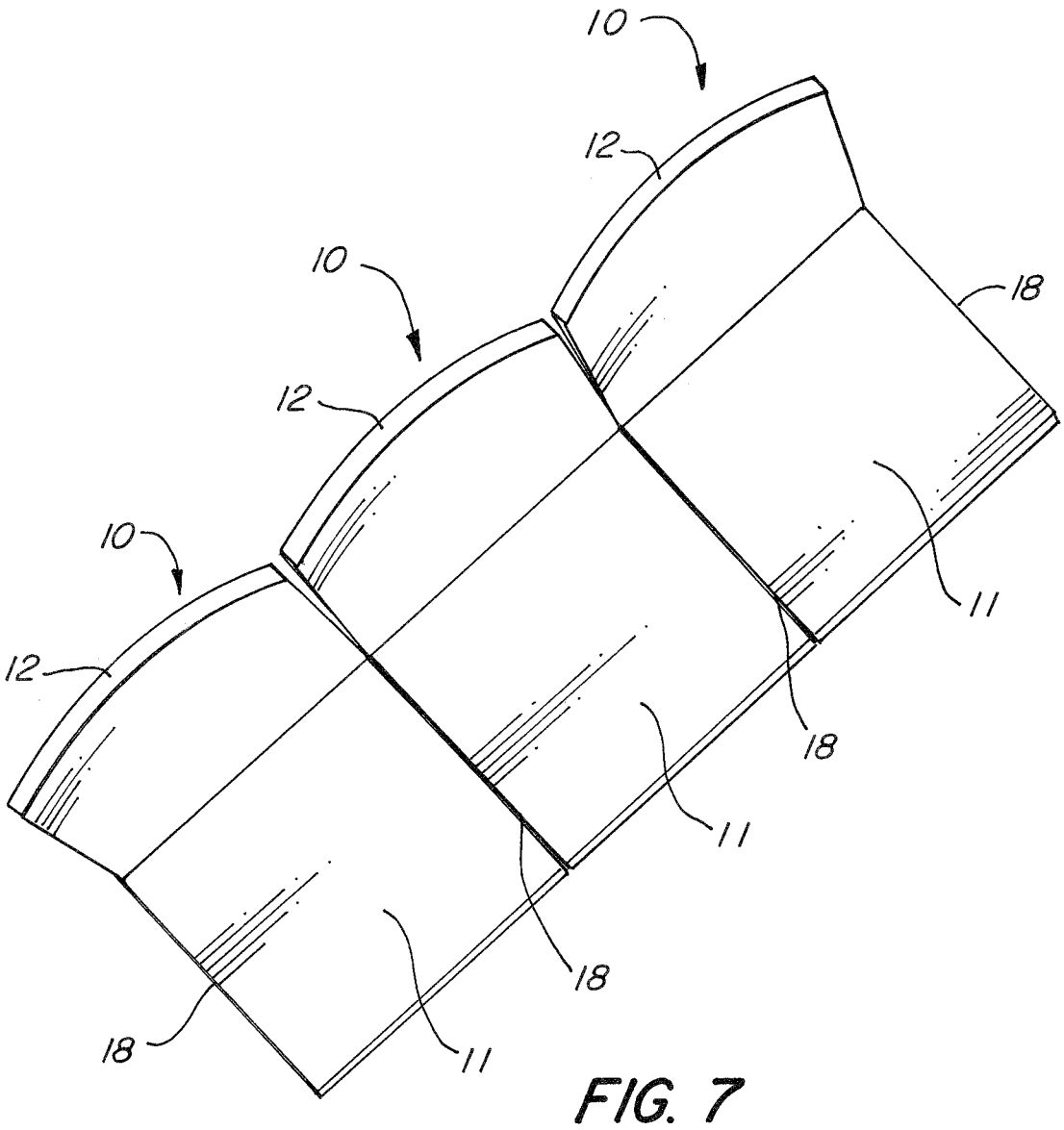
FIG. 7 is a top view of three stackable chairs with telescopic leg mechanisms of FIG. 1 positioned side-by-side with their seat elements flush against the other.

As shown in FIG. 6, when the telescopic leg mechanism 15 is in a fully retracted position, a series of stackable chairs 10 can be placed side-by-side. Specifically, the stackable chairs 10 can be placed flush with one another such that seat edges 18 of adjacent chairs are in contact. With no space present between the seat elements 11, the upper surfaces 16 form a continuous seating surface, similar to a bench. FIG. 7 shows a top view of three stackable chairs 10 with telescopic leg mechanisms 15 in fully retracted position placed side-by-side. With no space disposed between the stackable chairs, the stackable chairs provide for increased seating surface and increased comfort.

Figure 9:
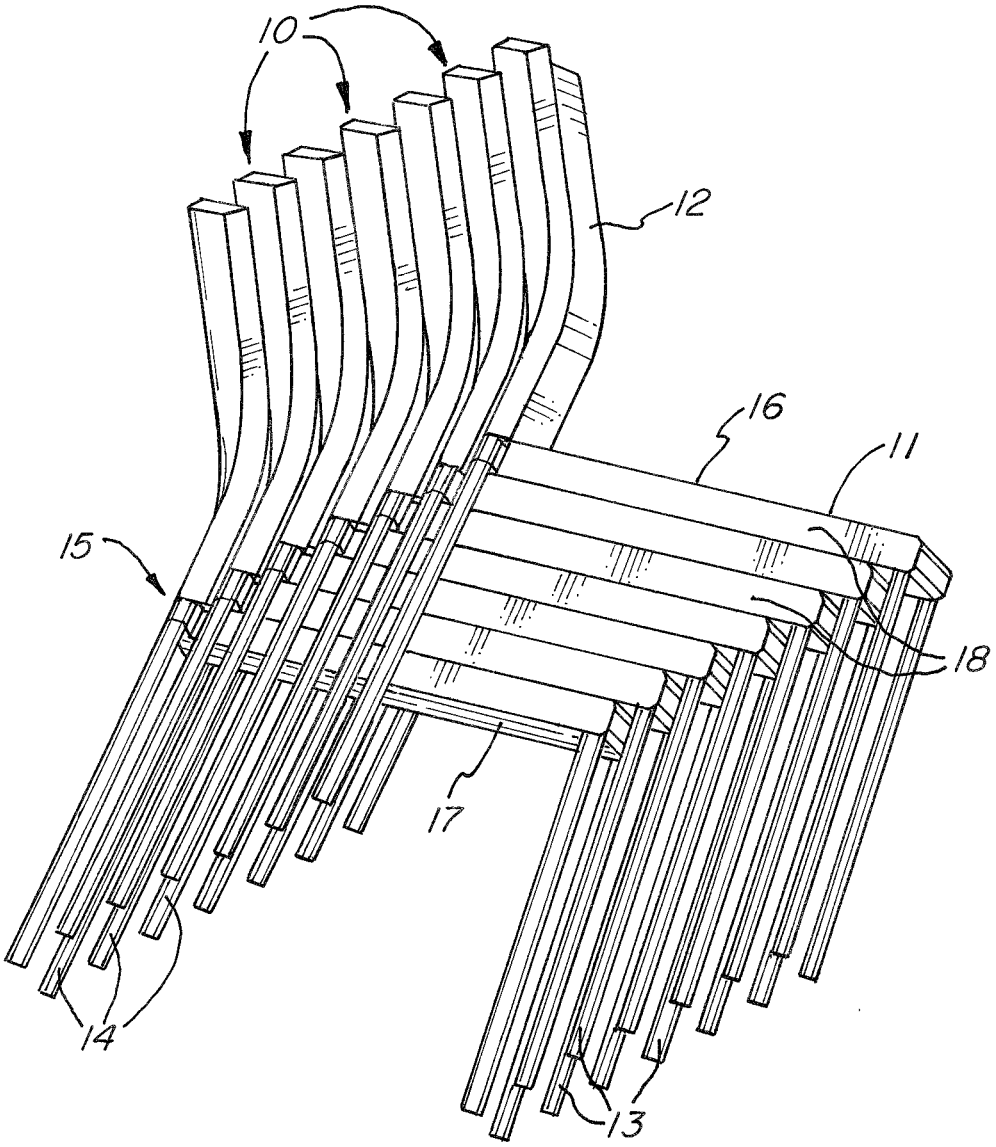
FIG. 9 is a side view of a plurality of stackable chairs with telescopic leg mechanisms of FIG. 2 in a vertical stack.

FIGS. 8 and 9 show a perspective and side view, respectively, of a plurality of stackable chairs 10 with telescopic leg mechanisms 15 in extended position to allow for stacking. By configuring the rear legs 14 and telescopic leg mechanism 15 in extended position, the distance between the rear legs 14 becomes wider than the seat element 11. This allows a stackable chair 10 to be loaded into an existing vertical stack of stackable chairs 10 using a forward motion. Moreover, with the rear legs 14 in extended position, there is no interference between the seat element 11 of one stackable chair 10 with the rear legs 14 of another stackable chair 10. This, in turn, allows the lower surfaces 17 and upper surfaces 16 of seat elements 11 of adjacently stacked stackable chairs 10 to be flush with one another. Unlike most prior art chairs, the stackable chairs 10 leave no open space between the seat elements 11. The number of stackable chairs 10 that can be placed in a stack in a given amount of area is greater than the number of prior art chairs that can be placed in a stack in the same amount of space. Thus, the stackable chair 10 with telescopic leg mechanism 15 promotes efficient use of space.

The modular structure of the stackable chair 10 with telescopic leg mechanism 15 also promotes high density stacking in a limited space, such as on a rolling cart or in a shipping crate. In an exemplary embodiment of the stackable chair with telescopic leg mechanism, at least twelve (12), and/or up to twenty-four (24), stackable chairs can be placed in a stack. Moreover, a further reduced thickness of seat element 11 may help with increasing the number of stackable chairs that can be stacked. The seat element 11 is designed to have a minimal thickness while still providing comfort and sufficient support for the weight of a person. For example, in some embodiments, the seating element 11 includes a thin foam pad or no foam pad at all. With less vertical space taken up by the seat element 11, higher density stacking can be achieved. Thus, depending on the thickness of the seat element 11, more than twenty-four (24) chairs are stackable in other embodiments.

Figure 10:
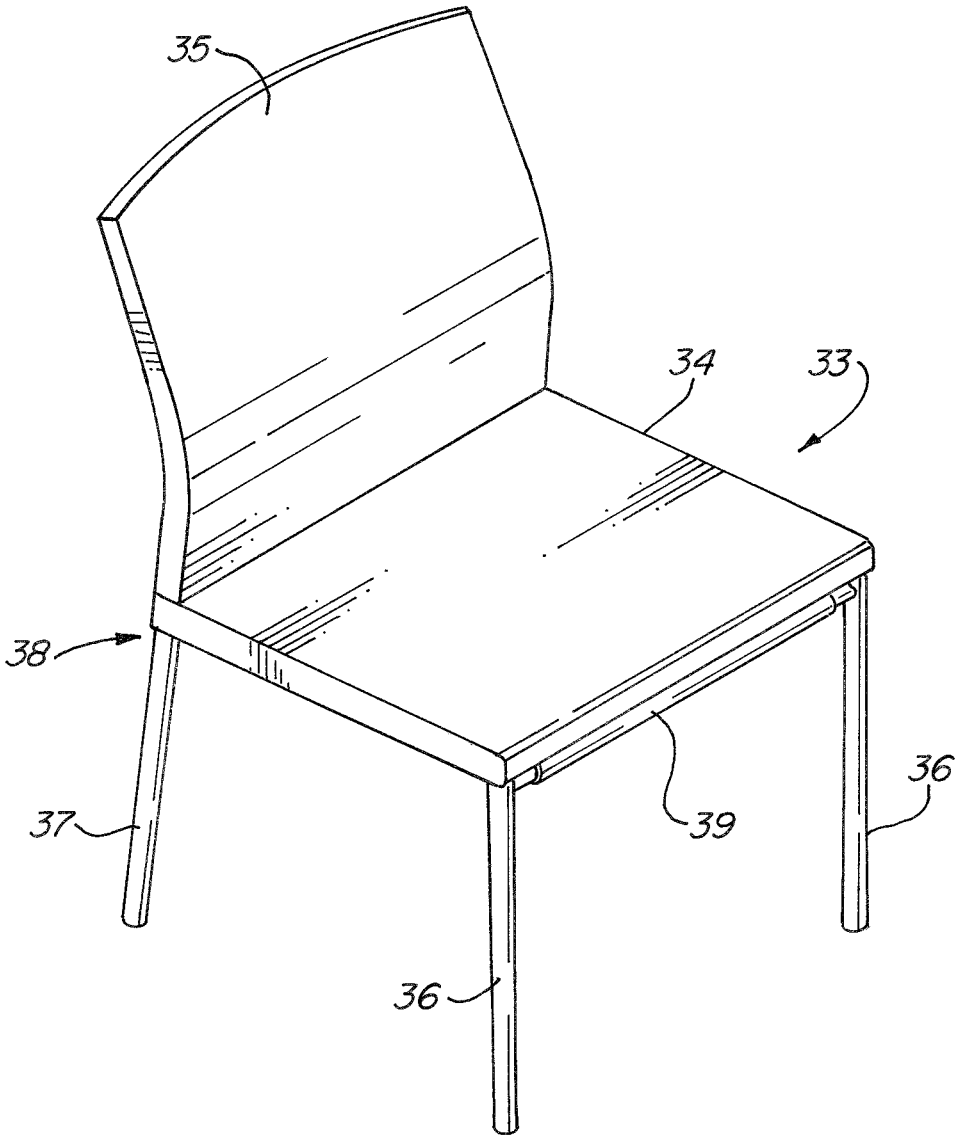
FIG. 10 is a perspective view of a stackable chair with telescopic leg mechanism according to a second embodiment of the present invention in a retracted position.
Figure 11:
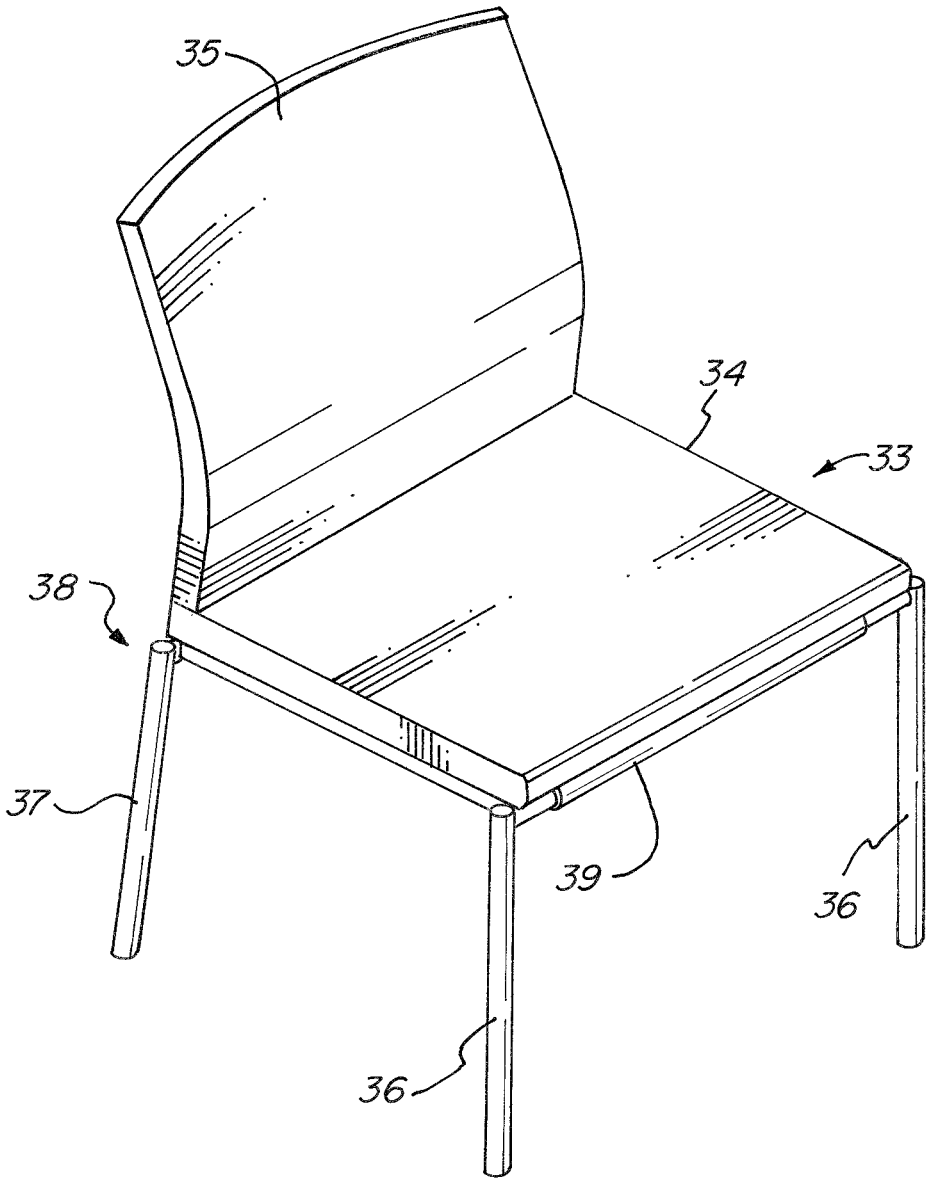
FIG. 11 is a perspective view of the stackable chair with telescopic leg mechanism shown in FIG. 10 in an extended position.

FIGS. 10 and 11 show a second embodiment of the stackable chair with more than one telescopic leg mechanism according to the present invention. FIG. 10, in particular, shows a stackable chair 33 having a seat element 34, backrest element 35, front legs 36, rear legs 37, and telescopic leg mechanisms 38, 39 located underneath the seat element 34 at the back and front of the chair 33. The telescopic leg mechanisms 38, 39 are in fully retracted positions, and thus the front legs 36 and rear legs 37 are positioned underneath and inline with the seat element 34. FIG. 11 shows both telescopic leg mechanisms 38, 39 in extended position such that both front legs 36 and rear legs 37 assume a wider stance. With both front legs 36 and rear legs 37 in extended position, the stackable chair 33 can be placed into a stack by means of a front-loading or top-loading maneuver without the front legs 36 or rear legs 37 interfering with a seat element 34 of another stackable chair 33. Furthermore, the telescopic leg mechanisms 38, 39 can be moved between the retracted position and the extended position independently of each other.

Although the invention has been described with reference to particular arrangement of parts, features, and the like, these are not intended to exhaust all possible arrangements or features, and indeed many modifications and variations will be ascertainable to those of skill in the art.

What is claimed is:

1. A stack of chairs, comprising:

two or more chairs;

each of said chairs comprising a seat frame, one or more front legs attached to a front portion of said seat frame, one or more rear legs attached to a back portion of said seat frame, a backrest element attached to said back portion of said seat frame, and one or more telescopic leg mechanisms disposed on at least one of said rear legs;

said one or more front legs of each chair being attached to the seat frame in a permanently immovable and non-rotatable configuration, and said one or more rear legs of each chair being moveable relative to the seat frame;

each of the one or more telescopic leg mechanisms providing independent lateral movement, between a retracted position and an extended position, of said at least one of said rear legs with respect to said seat frame while said rear legs are attached to said seat frame; and wherein each of the one or more telescopic leg mechanisms of each chair comprises a telescoping member attached to the rear legs, said telescoping member being adapted to be received in a lateral frame member of said seat frame;

a guide channel; and a guide pin, which extends into the guide channel upon receipt of said telescoping member into said lateral frame member and is slidable in the guide channel to a position that facilitates stacking of said at least two chairs:

wherein the one or more telescopic leg mechanisms of a first one of said chairs in the stack are disposed in the extended position such that said at least one of said rear legs of the first chair extend about the seat frame of a second one of said chairs below the first chair and such that said first chair with its backrest element nests with said second chair with its backrest element.

2. A method of stacking a plurality of chairs, each of said chairs having a seat element with a seat frame, a backrest element attached to said seat frame, a plurality of permanently immovable and non-rotatable front legs, and a plurality of moveable rear legs, the method comprising the steps of:

providing a telescopic leg mechanism for each of said rear legs of said chairs, wherein each of said telescopic leg mechanisms provides lateral movement of said rear legs with respect to said seat elements while said rear legs are attached to said seat frame, wherein each of said telescopic leg mechanisms comprises a telescoping member attached to the respective rear leg, said telescoping member being adapted to be received in a lateral frame member of said seat frame;

a guide channel; and a guide pin, which extends into the guide channel upon receipt of said telescoping member into said lateral frame member and is slidable in the guide channel to a position that facilitates stacking of said at least two chairs;

placing a first one of said plurality of chairs in a base position;

extending the telescopic leg mechanisms of a second one of said plurality of chairs into an extended position;

stacking said second chair on to said first chair using a substantially forward motion, wherein said extended position provides clearance for the rear legs of said second chair to avoid interference with the seat element, backrest element, and rear legs of said first chair, and provides for said second chair with its backrest element to nest with said first chair with its backrest element.

3. The method according to claim 2, further comprising the steps of:

extending the telescopic leg mechanisms of one or more third chairs selected from said plurality of chairs into the extended position;

stacking said one or more third chairs on to said first and second chairs using a substantially forward motion.

4. At least two chairs for facilitating efficient stacking, each chair comprising:

a seat element having a seat frame with a fixed width;

a backrest element attached to said back portion of said seat element;

a plurality of front legs attached to a front portion of said seat element, said front legs are attached to the seat element in a permanently immovable and non-rotatable configuration;

a plurality of rear legs attached to a back portion of said seat element, said rear legs are moveable relative to the seat element; and one or more telescopic leg mechanisms disposed on said rear legs, said one or more telescopic leg mechanisms providing lateral movement of said rear legs with respect to said seat element while said rear legs are attached to said seat element;

wherein each of said one or more telescopic leg mechanisms of each chair comprises a telescoping member attached to the rear legs, said telescoping member being adapted to be received in a lateral frame member of said seat frame;

a guide channel; and a guide pin, which extends into the guide channel upon receipt of said telescoping member into said lateral frame member and is slidable in the guide channel to a position that facilitates stacking of said at least two chairs;

wherein said one or more telescopic leg mechanisms of said at least two chairs provide for said chairs with the backrest elements to nest with each other.

5. The chairs of claim 4, wherein the telescoping member of each of said one or more telescopic leg mechanisms of each chair has a proximal end and a distal end, said proximal end attached to the rear legs.

6. The chairs of claim 5, wherein said guide pin within said guide channel limits the lateral movement of said telescoping member into and out of said lateral frame member.

7. The chairs of claim 5, wherein said guide pin is spring-loaded such that said guide pin is retractably secured within said guide channel.

8. The chairs of claim 5, wherein each of said telescopic leg mechanisms further comprises a locking mechanism that prohibits the lateral movement of the rear legs by securing said telescoping member at a specified position within said lateral frame member.

9. The chairs of claim 5, wherein said guide channel is disposed within the lateral frame member of said seat frame and said guide pin is disposed within a side portion of said telescoping member.

10. The chairs of claim 5, wherein said guide channel is disposed within a side portion of said telescoping member and said guide pin is disposed within the lateral frame member of said seat frame.

11. The chairs of claim 10, wherein said guide channel comprises:

an outer end substantially adjacent to the proximal end of said telescoping member, wherein said outer end defines the extent that said telescoping member can retract into said lateral frame member; and an inner end substantially adjacent to the distal end of said telescoping member, wherein said inner end defines the extent that said telescoping member can extend out of said lateral frame member.

12. The chairs of claim 4, wherein each of said telescopic leg mechanisms of each chair are moveable between a retracted position and an extended position.

13. The chairs of claim 12, wherein said retracted position provides for said chairs to be placed side-by-side next to each other, and provides for said seat elements of said chairs to be flush with each other to create a continuous seating surface.

14. The chairs of claim 12, wherein said extended position provides clearance during stacking for the rear legs of a first chair of said at least two chairs to avoid interference with seat elements, backrest elements, rear legs, and front legs of one or more second chairs of said at least two chairs disposed with said first chair in a stack.

15. The chairs of claim 14, wherein each seat frame of said at least two chairs is disposed inside a seat material having an upper surface and a lower surface;

said upper surface of said first chair is flush with a lower surface of a third chair and said lower surface of said first chair is flush with an upper surface of said second chair when said first chair is in said stack.

16. The chairs of claim 14, wherein said extended position provides for said chairs to be placed into said stack using a forward motion without lifting said rear legs and front legs of said first chair over said one or more second chairs.

17. At least two chairs for facilitating efficient stacking, each chair comprising:

a seat element having a seat frame with a fixed width;

a backrest element attached to said back portion of said seat element;

a plurality of front legs attached to a front portion of said seat element, said front legs are attached to the seat element in a permanently immovable and non-rotatable configuration;

a plurality of rear legs attached to a back portion of said seat element, said rear legs are moveable relative to the seat element;

at least one first telescopic leg mechanism disposed on at least one of said rear legs; and at least one second telescopic leg mechanism disposed on at least another of said rear legs;

said first and second telescopic leg mechanisms providing lateral movement of said rear legs with respect to said seat element while said rear legs are attached to said seat element;

wherein each of said first and second telescopic leg mechanisms of each chair comprises a telescoping member attached to the respective rear leg, said telescoping member being adapted to be received in a lateral frame member of said seat frame;

a guide channel; and a guide pin, which extends into the guide channel upon receipt of said telescoping member into said lateral frame member and is slidable in the guide channel to a position that facilitates stacking of said at least two chairs;

wherein said first and second telescopic leg mechanisms of said at least two chairs provide for said chairs with the backrest elements to nest with each other.

18. The chairs of claim 17, wherein said telescoping member of each of said first and second telescopic leg mechanisms of each chair has a proximal end and a distal end, said proximal end attached to the at least one of said rear legs for said first telescopic leg mechanisms or to the at least another of said rear legs for said second telescopic leg mechanisms.

19. The chairs of claim 18, wherein said guide pin within said guide channel limits the lateral movement of said telescoping member into and out of said lateral frame member.

20. The chairs of claim 18, wherein said guide pin is spring-loaded such that said guide pin is retractably secured within said guide channel.

21. The chairs of claim 18, wherein each of said first and second telescopic leg mechanisms further comprises a locking mechanism that prohibits the lateral movement of the at least one of said rear legs or the at least another of said rear legs, respectively, by securing said telescoping member at a specified position within said lateral frame member.

22. The chairs of claim 18, wherein said guide channel is disposed within the lateral frame member of said seat frame and said guide pin is disposed within a side portion of said telescoping member.

23. The chairs of claim 18, wherein said guide channel is disposed within a side portion of said telescoping member and said guide pin is disposed within said the lateral frame member of said seat frame.

24. The chairs of claim 23, wherein said guide channel comprises:

an outer end substantially adjacent to the proximal end of said telescoping member, wherein said outer end defines the extent that said telescoping member can retract into said lateral frame member; and an inner end substantially adjacent to the distal end of said telescoping member, wherein said inner end defines the extent that said telescoping member can extend out of said lateral frame member.

25. The chairs of claim 17, wherein each of said first and second telescopic leg mechanisms of each chair is independently movable between a retracted position and an extended position.

26. The chairs of claim 25, wherein said retracted position provides for said chairs to be placed side-by-side next to each other, and provides for said seat elements of said chairs to be flush with each other to create a continuous seating surface.

27. The chairs of claim 25, wherein said extended position provides clearance during stacking for the rear legs of a first chair of said at least two chairs to avoid interference with seat elements, backrest elements, rear legs, and front legs of one or more second chairs of said at least two chairs disposed with said first chair in a stack.

28. The chairs of claim 27, wherein each seat frame of said at least two chairs is disposed inside a seat material having an upper surface and a lower surface;

said upper surface of said first chair is flush with a lower surface of a third chair and said lower surface of said first chair is flush with an upper surface of said second chair in said stack.

29. The chairs of claim 27, wherein said extended position provides for said chairs to be placed into said stack using a forward motion without lifting said rear legs and front legs of said first chair over said one or more second chairs.

* * * * *